US009835984B2

(12) United States Patent
Suzuki

(10) Patent No.: US 9,835,984 B2
(45) Date of Patent: Dec. 5, 2017

(54) LIQUID DEVELOPER SUPPLY DEVICE, DEVELOPING DEVICE, AND IMAGE FORMING APPARATUS

(71) Applicant: FUJI XEROX CO., LTD., Tokyo (JP)

(72) Inventor: Toshihiko Suzuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/208,105

(22) Filed: Jul. 12, 2016

(65) Prior Publication Data

US 2017/0235253 A1 Aug. 17, 2017

(30) Foreign Application Priority Data

Feb. 16, 2016 (JP) ..... 2016-026697

(51) Int. Cl.
*G03G 15/10* (2006.01)

(52) U.S. Cl.
CPC ..... *G03G 15/104* (2013.01)

(58) Field of Classification Search
CPC ..... G03G 15/104; G03G 15/10; G03G 2215/0658; B41F 35/04
USPC ..... 399/237, 238; 101/425
See application file for complete search history.

(56) References Cited

U.S. PATENT DOCUMENTS

2009/0148189 A1* 6/2009 Fukazawa ..... G03G 15/104 399/238
2011/0217081 A1 9/2011 Yoshie et al.
2012/0167791 A1* 7/2012 Nadachi ..... B41F 35/04 101/425

FOREIGN PATENT DOCUMENTS

JP 2011-203719 A 10/2011
JP 2015-089620 A 5/2015

* cited by examiner

*Primary Examiner* — Sandra Brase
(74) *Attorney, Agent, or Firm* — Oliff PLC

(57) ABSTRACT

Provided is a liquid developer supply device including a supply roller that rotates and holds liquid developer in a recessed portion formed in an outer circumferential surface to supply the liquid developer to a receiving member, a liquid developer supply unit that supplies liquid developer between a seal member which is in contact with the supply roller on an upstream side in a rotating direction and a regulation member which is in contact with the supply roller on a downstream side, and that forms a liquid developer reservoir, and a supply unit that supplies a cleaning liquid to a contact portion from an upstream side of the contact portion between the supply roller and the seal member, in the rotating direction of the supply roller, such that the cleaning liquid flows down along the seal member due to gravity.

20 Claims, 10 Drawing Sheets

LIQUID DEVELOPER SUPPLY DEVICE, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2016-026697 filed Feb. 16, 2016.

BACKGROUND

Technical Field

The present invention relates to a liquid developer supply device, a developing device, and an image forming apparatus.

SUMMARY

According to an aspect of the invention, there is provided a liquid developer supply device including:

a supply roller that rotates and holds liquid developer in a recessed portion formed in an outer circumferential surface to supply the liquid developer to a receiving member;

a liquid developer supply unit that supplies liquid developer between a seal member which is in contact with the supply roller on an upstream side in a rotating direction and a regulation member which is in contact with the supply roller on a downstream side, and that forms a liquid developer reservoir; and a supply unit that supplies a cleaning liquid to a contact portion from an upstream side of the contact portion between the supply roller and the seal member, in the rotating direction of the supply roller, such that the cleaning liquid flows down along the seal member due to gravity.

BRIEF DESCRIPTION OF THE DRAWINGS

Exemplary embodiments of the present invention will be described in detail based on the following figures, wherein.

DETAILED DESCRIPTION

Figure 1:
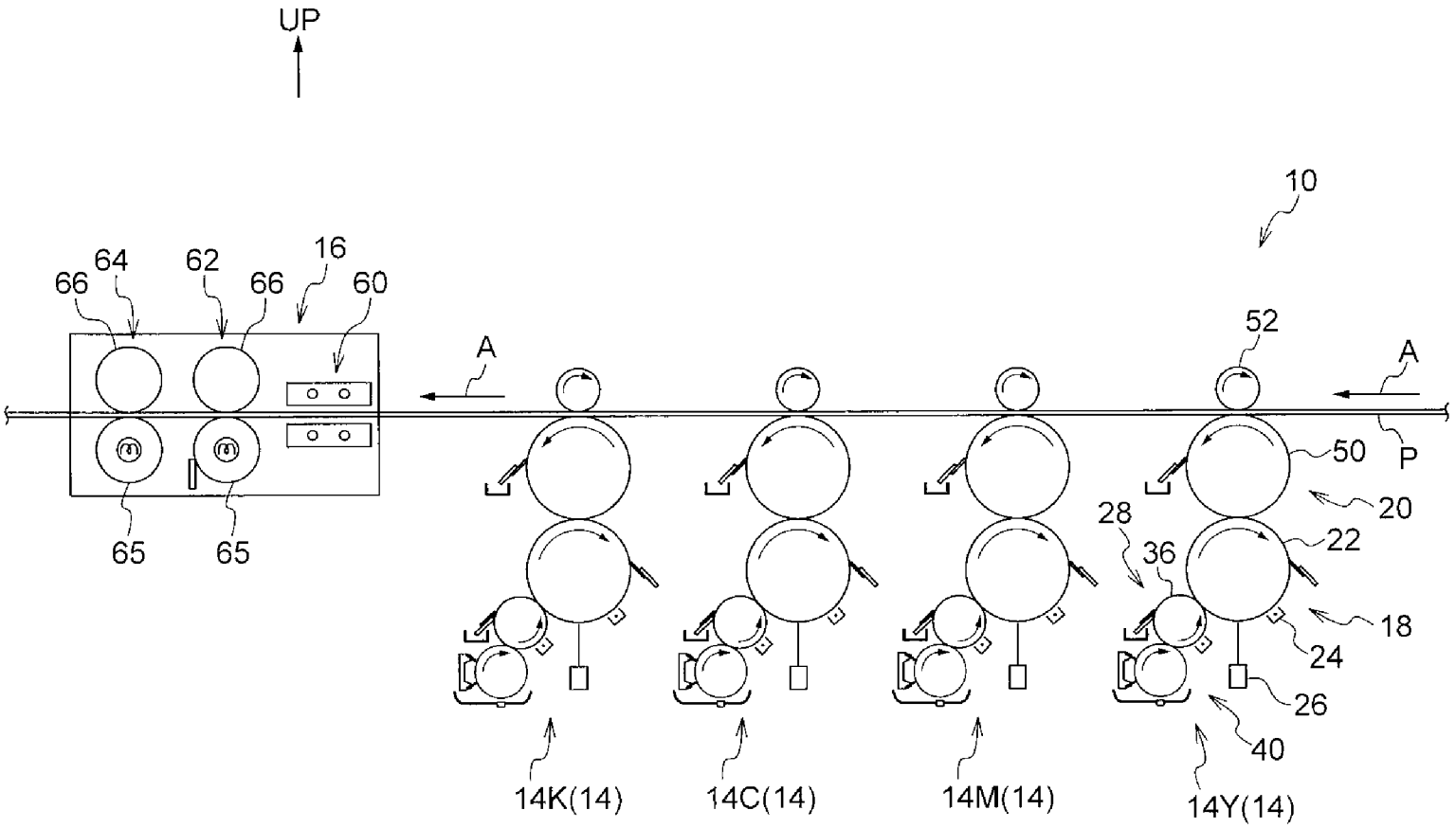
FIG. 1 is a view showing a configuration of an image forming apparatus including a liquid developer supply device according to a first exemplary embodiment of the invention.

Hereinafter, exemplary embodiments of an image forming apparatus of the invention will be described with reference to the drawings. Note that arrows UP shown in the drawings represent an upper side in a vertical direction of the apparatus.

First Exemplary Embodiment

Configuration of Image Forming Apparatus

FIG. 1 shows an example of an image forming apparatus 10 that includes a liquid developer supply device 40 of the first exemplary embodiment. As shown in FIG. 1, the image forming apparatus 10 includes a transport member (not shown) that transports continuous paper P as an example of a recording medium in a direction of arrow A, an image forming system 14 that forms a toner image on the continuous paper P, and a fixing device 16 that fixes the toner image to the continuous paper P. The image forming system 14 includes an image forming system 14Y that forms a yellow (Y) toner image, an image forming system 14M that forms a magenta (M) toner image, an image forming system 14C that forms a cyan (C) toner image, and an image forming system 14K that forms a black (K) toner image. In the image forming apparatus 10, as an example, the image forming systems 14Y, 14M, 14C, and 14K are arranged in this order from an upstream side in a transport direction of the continuous paper P.

Each of the image forming systems 14Y, 14M, 14C, and 14K of the respective colors includes an image forming unit 18 that forms a toner image using liquid developer G in which toner and an insulating liquid are contained, and a transfer unit 20 that transfers the toner image formed by the image forming unit 18 to the continuous paper P. In the exemplary embodiment, the continuous paper P is transported by the transport member (not shown) in a lateral direction (direction of the arrow A) and the image forming systems 14Y, 14M, 14C, and 14K of the respective colors are arranged side by side in the lateral direction.

Figure 2:
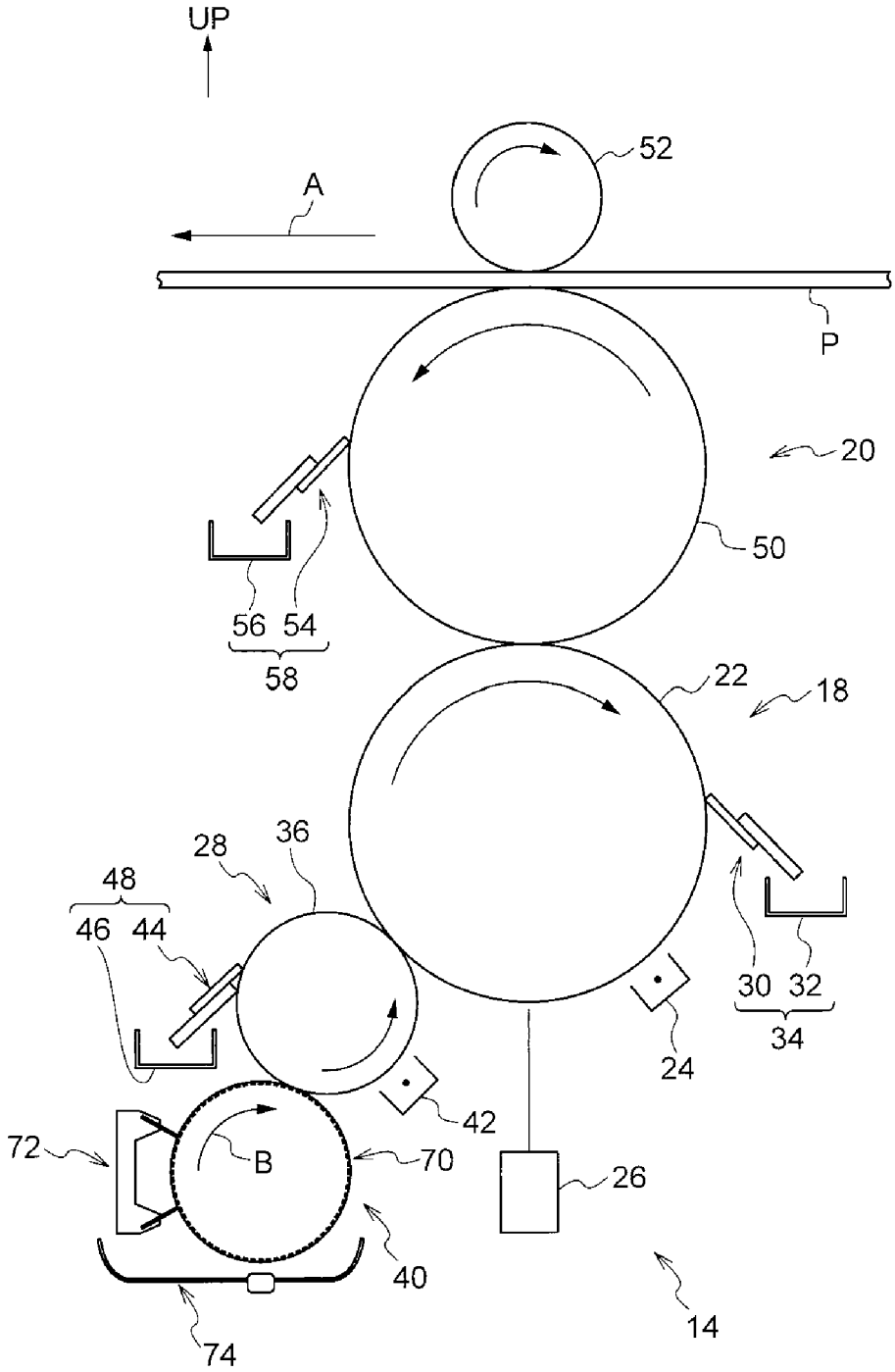
FIG. 2 is a view showing a configuration of the liquid developer supply device and a developing device which are used in the image forming apparatus shown in FIG. 1.

As shown in FIG. 2, the image forming unit 18 includes an image holding member 22 that rotates and holds a toner image, a charging device 24 that charges the image holding member 22, an exposure device 26 that irradiates the image holding member 22 with exposure light so as to form an electrostatic latent image, and a developing device 28 that develops, as a toner image, the electrostatic latent image on the image holding member 22. Further, the image forming unit 18 is provided with a cleaning device 34 that includes a scraping blade 30 that scrapes, from the image holding member 22, the liquid developer G remaining on an outer circumferential surface of the image holding member 22 such that no image is transferred to a transfer roller 50, which will be described below, from the image holding member 22, and a collecting member 32 that collects the scraped liquid developer G.

The developing device 28 includes a developing roller 36 as an example of a receiving member, which rotates and develops the electrostatic latent image formed on the image holding member 22 with the liquid developer G. In addition, the developing device 28 includes the liquid developer supply device 40 that supplies the liquid developer G to the developing roller 36, and a charging device 42 that charges toner contained in the liquid developer G supplied to the developing roller 36. Further, the developing device 28 is provided with a cleaning device 48 that includes a scraping blade 44 that scrapes, from the developing roller 36, the liquid developer G remaining on an outer circumferential surface of the developing roller 36 after development, and a collecting member 46 that collects the scraped liquid developer G.

The liquid developer G used in the exemplary embodiment is a liquid type of developer in which toner (particles) is dispersed in a carrier liquid, and as the carrier liquid, an insulating liquid such as vegetable oil, liquid paraffin oil, or silicone oil is used. In addition, an average particle diameter of the toner in the liquid developer G is, as an example, 0.5 μm to 5 μm, and the toner (particles) is dispersed at a concentration of 15 wt % to 45 wt % in the carrier liquid.

In the developing device 28, the toner contained in the liquid developer G supplied to the outer circumferential surface of the developing roller 36 is charged by the charging device 42 such that the electrostatic latent image on the image holding member 22 is developed as a toner image with the liquid developer G on the outer circumferential surface of the developing roller 36. Note that, in a case where the electrostatic latent image is developed as the toner image using the liquid developer G, the carrier liquid also migrates to the image holding member 22.

The transfer unit 20 includes the transfer roller 50 which is rotatably disposed to face the image holding member 22 and to which the toner image on the image holding member 22 is transferred by an electric field formed between the image holding member 22 and the transfer roller 50. Further, the transfer unit 20 includes a backup roller 52 that is disposed on a side opposite to the transfer roller 50 with the continuous paper P interposed therebetween, and that transfers the toner image on the transfer roller 50 to the continuous paper P by an electric field formed between the transfer roller 50 and the backup roller 52. Furthermore, the transfer unit 20 is provided with a cleaning device 58 that includes a scraping blade 54 that scrapes, from the transfer roller 50, the liquid developer G remaining on an outer circumferential surface of the transfer roller 50 after the transfer, and a collecting member 56 that collects the scraped liquid developer G.

In the transfer unit 20, the toner image on the image holding member 22 is transferred to the transfer roller 50 and the toner image transferred to the transfer roller 50 is transferred to the continuous paper P. Note that the carrier liquid migrating from the developing roller 36 to the image holding member 22 also migrates to the continuous paper P via the transfer roller 50.

As shown in FIG. 1, the fixing device 16 includes a heating unit 60 that heats the continuous paper P, a carrier liquid removing unit 62 that removes the carrier liquid from the continuous paper P, and a fixing unit 64 that fixes the toner image to the continuous paper P. Each of the carrier liquid removing unit 62 and the fixing unit 64 includes a heating roller 65 and a pressure roller 66 that presses the continuous paper P against the heating roller 65.

In the fixing device 16, the heating unit 60 heats the continuous paper P, the toner and the carrier liquid (oil) contained in the liquid developer G on the continuous paper P are separated from each other, and then an oil layer is formed on the toner. Further, the carrier liquid (oil) is removed by the carrier liquid removing unit 62, and the continuous paper P is heated and pressurized by the fixing unit 64 such that the toner image is fixed to the continuous paper P.

In the image forming apparatus 10 described above, the image holding member 22 of the image forming units 18 of the respective colors rotates and the outer circumferential surface of the image holding member 22 is charged by the charging device 24. Next, the outer circumferential surface of the image holding member 22 is exposed by the exposure device 26, and the electrostatic latent image is formed on the outer circumferential surface of the image holding member 22. Then, the electrostatic latent image is developed as the toner image by the developing device 28. Further, the toner image formed on the outer circumferential surface of the rotating image holding member 22 is primarily transferred to the transfer roller 50. The toner image primarily transferred to the transfer roller 50 is transferred to the continuous paper P which is transported in the direction of the arrow A. This process is performed in the image forming systems 14 of the respective colors, and a toner image, on which the respective colors are superimposed, is formed on the continuous paper P. Further, the carrier liquid (oil) is removed on the transported continuous paper P by the fixing device 16, and the toner image is fixed to the continuous paper P.

Configuration of Liquid Developer Supply Device

Next, the liquid developer supply device 40 will be described.

Figure 3:
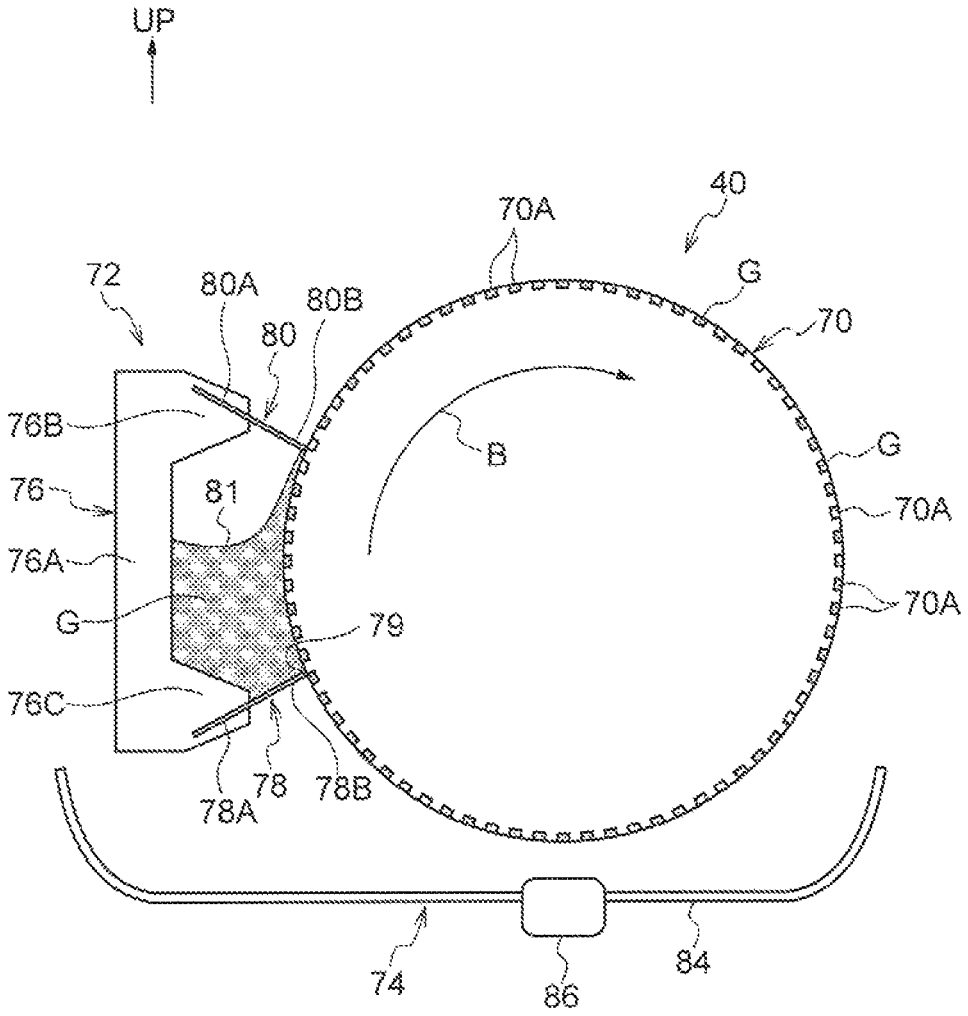
FIG. 3 is a view showing a configuration of the liquid developer supply device shown in FIG. 2 and showing a state when an image is formed.

FIG. 3 shows a state of the liquid developer supply device 40 of the first exemplary embodiment when an image is formed. As shown in FIG. 3, the liquid developer supply device 40 includes a supply roller 70 that rotates and holds the liquid developer G so as to supply the liquid developer G to the developing roller 36 (refer to FIG. 2), and a chamber 72 as an example of a liquid developer supply unit that supplies the liquid developer G to the supply roller 70. In addition, the liquid developer supply device 40 includes a cleaning liquid supply device 74 as an example of a supply unit that supplies, when cleaning the supply roller 70, a cleaning liquid L to a contact portion 79 from an upstream side of the contact portion 79 between the supply roller 70 and a seal blade 78 which will be described below (refer to FIG. 5).

The supply roller 70 is an anilox roller that holds the liquid developer G and supplies the liquid developer G to a contact portion (refer to FIG. 2) with the developing roller 36. To be more specific, the supply roller 70 has plural cells 70A as an example of recessed portions that are arranged in the outer circumferential surface thereof and are recessed to the inner side in a radial direction. The cell 70A has a volume that may hold the liquid developer G and, with the volume, a pattern of arrangement of the cells 70A is unlikely to be viewed in the toner image. The cell is, as an example, about 12 ml (milliliters)/$m^2$ in volume. Note that FIG. 3 is a schematic view showing the plural rectangular cells 70A arranged in the outer circumferential surface of the supply roller 70 at intervals; however, in reality, the supply roller 70 has the cells 70A which are smaller in size and the cells 70A are arranged at narrower intervals.

The chamber 72 includes a storage member 76 that stores the liquid developer G, the seal blade 78 as an example of a seal member that is disposed on an upstream side in a rotating direction (direction of arrow B) of the supply roller 70, and a regulation blade (doctor blade) 80 as an example of a regulation member which is disposed on a downstream side in the rotating direction of the supply roller 70. The chamber 72 is disposed in a region in which the supply roller 70 rotates in the rotating direction (direction of the arrow B) from the lower side in the vertical direction toward the upper side in the vertical direction.

The storage member 76 is formed to have a box shape which is opened toward the supply roller 70 side. The storage member 76 is disposed to have the longitudinal direction thereof is matched with an axial direction of the supply roller 70. To be more specific, the storage member 76 has a side portion 76A disposed to face a circumferential surface of the supply roller 70 in a cross-sectional view, a downstream-side protruding portion 76B that protrudes from one end portion (end portion on the downstream side in the rotating direction of the supply roller 70) of the side portion 76A toward the supply roller 70 side, and an upstream-side protruding portion 76C that protrudes from the other end portion (end portion on the upstream side in the rotating direction of the supply roller 70) of the side portion 76A toward the supply roller 70 side. In the exemplary embodiment, the side portion 76A of the storage member 76 is disposed in the vertical direction, the downstream-side protruding portion 76B is disposed at an upper end portion of the side portion 76A, and the upstream-side protruding portion 76C is disposed at a lower end portion of the side portion 76A. Each of the downstream-side protruding portion 76B and the upstream-side protruding portion 76C is formed to have a trapezoidal shape of which a length in the vertical direction is reduced toward the supply roller 70 side.

A base end portion 78A of the seal blade 78 is supported in the upstream-side protruding portion 76C of the storage member 76. A front end portion 78B of the seal blade 78 is in contact with the outer circumferential surface of the supply roller 70, and the contact portion 79 is formed between the front end portion 78B of the seal blade 78 and the supply roller 70. The seal blade 78 is disposed to be inclined such that the front end portion 78B is disposed on the upper side from the base end portion 78A in the vertical direction. In other words, the seal blade 78 is disposed so as to be sloped downward to the base end portion 78A side from the front end portion 78B that is in contact with the supply roller 70. The front end portion 78B of the seal blade 78 is in contact with the supply roller 70 in a direction toward the downstream side in the rotating direction (direction of the arrow B) of the supply roller 70. The seal blade 78 is formed of, as an example, metal such as stainless steel.

A base end portion 80A of the regulation blade 80 is supported in the downstream-side protruding portion 76B of the storage member 76, and a front end portion 80B of the regulation blade 80 is in contact with the outer circumferential surface of the supply roller 70. The regulation blade 80 is disposed to be inclined such that the front end portion 80B is disposed on the lower side from the base end portion 80A in the vertical direction. In other words, the regulation blade 80 is disposed so as to be sloped upward to the base end portion 80A side from the front end portion 80B that is in contact with the supply roller 70. The front end portion 80B of the regulation blade 80 is in contact with the supply roller 70 in a direction toward the upstream side in the rotating direction (direction of the arrow B) of the supply roller 70. The regulation blade 80 is formed of, as an example, metal such as stainless steel.

A supply tube (not shown), which supplies the liquid developer G from a storage tank (not shown) into the inner side of the storage member 76 using a pump, is connected to a lower portion of the side portion 76A of the storage member 76. In this manner, the liquid developer G flows into a portion surrounded by the storage member 76, the seal blade 78, and the regulation blade 80, and a liquid developer reservoir 81 is formed in the inside (in the exemplary embodiment, the seal blade 78 side on the lower side in the vertical direction) of the chamber 72. Note that a surplus of liquid developer G in the chamber 72 is discharged through a discharge tube (not shown) disposed on the upper side of the side portion 76A of the storage member 76 to the outside of the chamber 72.

Figure 4:
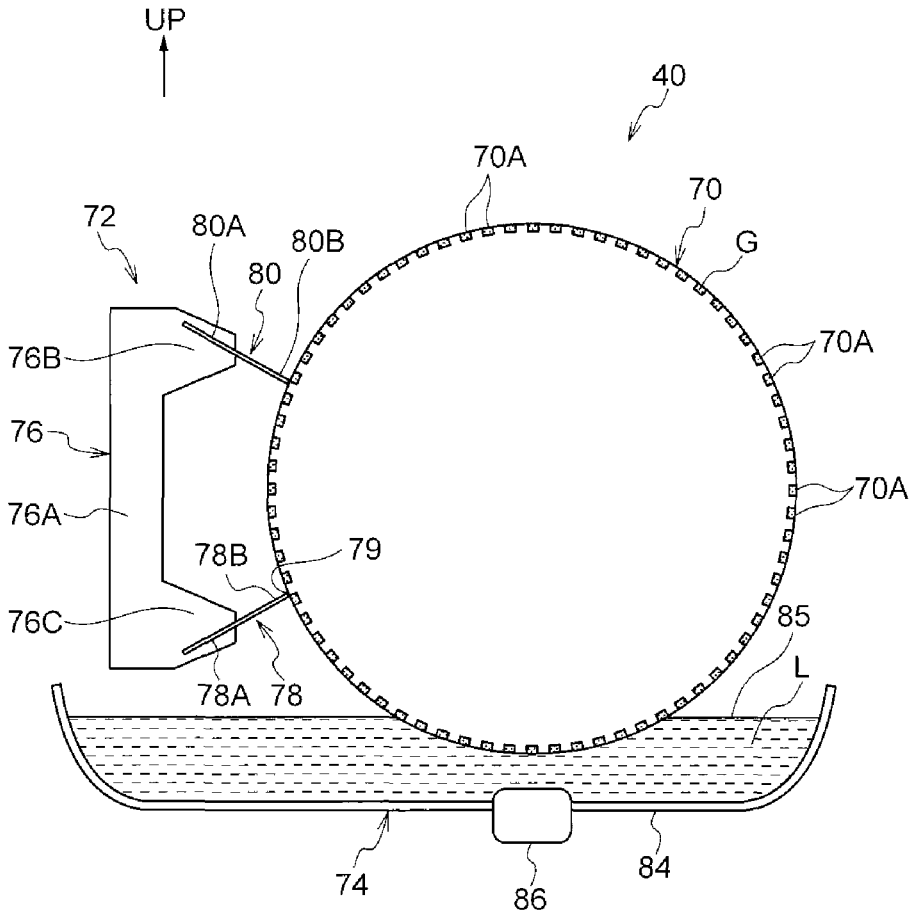
FIG. 4 is a view showing a configuration of a cleaning process in the liquid developer supply device shown in FIG. 3.

The cleaning liquid supply device 74 has a function of supplying the cleaning liquid L to the contact portion 79 from the upstream side of the contact portion 79 between the supply roller 70 and the seal blade 78 in the rotating direction of the supply roller 70, when the liquid developer supply device 40 is cleaned in a process different from the process executed when the image is formed. A cleaning process of the liquid developer supply device 40 is performed, as an example, after the image is formed or a predetermined period of time elapses after the image is formed. As shown in FIG. 4, the cleaning liquid supply device 74 includes a cleaning vessel 84 that is disposed on the lower side of the supply roller 70 and stores the cleaning liquid L. The cleaning vessel 84 is formed to have a bowl shape so as to surround an outer circumferential surface of the supply roller 70 on the lower side. In addition, the cleaning vessel 84 extends to a position so as to be disposed on the lower side from the chamber 72. A supply tube (not shown), which supplies the cleaning liquid L from the storage tank (not shown) to the inside of the cleaning vessel 84 using a pump, is connected to a bottom wall of the cleaning vessel 84.

As the cleaning liquid L, as an example, a carrier liquid that forms the liquid developer, or an organic solvent, in which any of isopropyl alcohol or acetone is contained, is used.

As shown in FIG. 4, the cleaning liquid L is supplied into the inside of the cleaning vessel 84 and, thereby, a cleaning liquid reservoir portion 85 is formed in the inside of the cleaning vessel 84. In this manner, a lower portion of the supply roller 70 as an example of a part of the supply roller 70 is immersed into the cleaning liquid reservoir portion 85. The lower portion of the supply roller 70 is immersed into the cleaning liquid reservoir portion 85 of the cleaning vessel 84 at a position on the upstream side of the contact portion 79 between the supply roller 70 and the seal blade 78 in the rotating direction (direction of the arrow B) of the supply roller 70 (refer to FIG. 5). In other words, the seal blade 78 is disposed in a range in which the supply roller 70 moves upward from the cleaning liquid reservoir portion 85 of the cleaning vessel 84 (refer to FIG. 5).

In the exemplary embodiment, the seal blade 78 is disposed on the lower side from the central portion of the supply roller 70 in the vertical direction. In addition, the seal blade 78 is disposed such that a surface thereof on the side opposite to the liquid developer reservoir 81 (refer to FIG. 3) is directed downward.

Figure 5:
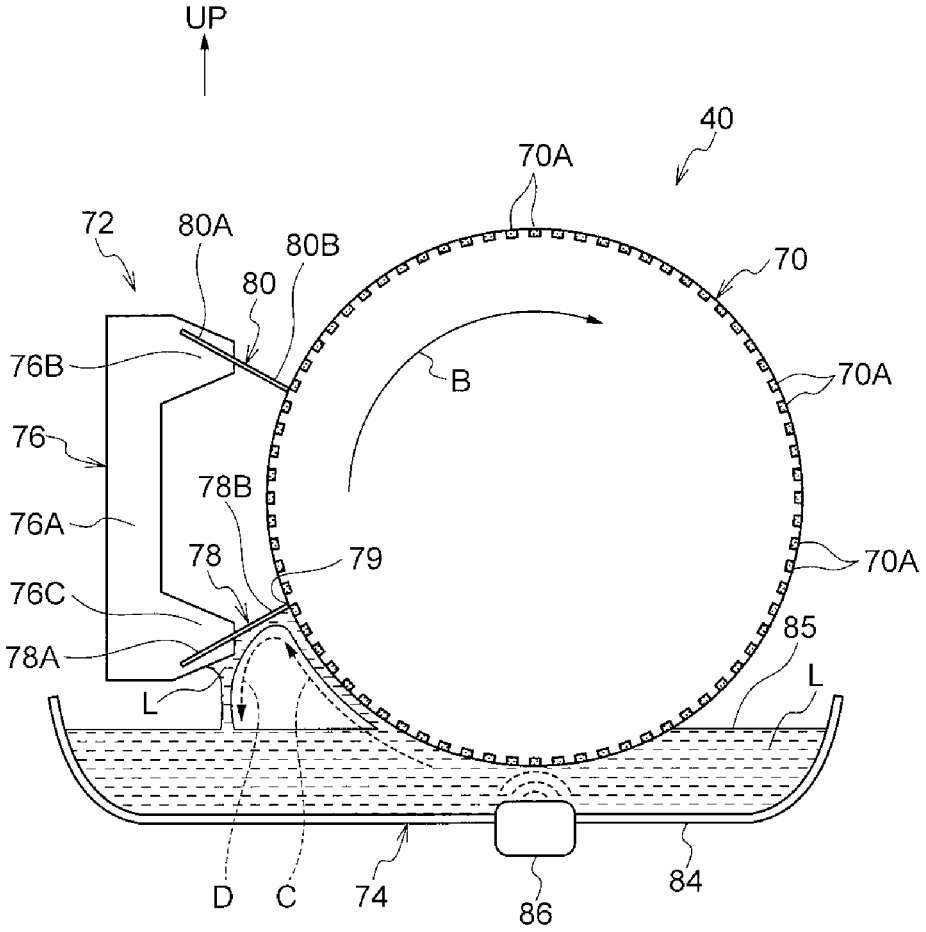
FIG. 5 is a view showing a configuration of the cleaning process of the liquid developer supply device shown in FIG. 3 and showing a state during cleaning.

As shown in FIG. 5, when the supply roller 70 is caused to rotate in the direction of the arrow B, the cleaning liquid L is attached to the outer circumferential surface of the supply roller 70 and is brought along in the direction of arrow C due to the rotation of the supply roller 70 (in the state of being attached to the outer circumferential surface of the supply roller 70). In this manner, the cleaning liquid L is supplied to the contact portion 79 from the upstream side of the contact portion 79 between the supply roller 70 and the seal blade 78. Then, since the seal blade 78 is disposed to be sloped downward from the front end portion 78B to the base end portion 78A, the cleaning liquid L supplied to the contact portion 79 flows down along the seal blade 78 due to gravity (flows down along the lower surface of the seal blade 78). The cleaning vessel 84 is disposed at a position at which the cleaning liquid L after flowing down along the seal blade 78 is received, and thus, the cleaning liquid L after flowing down is collected in the cleaning vessel 84.

In addition, a discharge tube (not shown), through which the cleaning liquid L is discharged, is connected to a bottom wall of the cleaning vessel 84, and an on-off valve (not shown) is provided in the discharge tube. In the exemplary embodiment, as an example, the on-off valve is closed in the cleaning process such that the cleaning liquid L is supplied to the cleaning vessel 84. In addition, in the exemplary embodiment, as an example, the on-off valve is opened after the cleaning process such that the cleaning liquid L is discharged from the cleaning vessel 84.

An ultrasonic oscillator 86 as an example of a replacement portion is provided in a lower portion of the cleaning vessel 84. The ultrasonic oscillator 86 is provided with an ultrasonic vibrator (not shown) that generates an ultrasonic wave and drives the ultrasonic vibrator, and thereby, the cleaning liquid L in the inside of the cleaning vessel 84 vibrates due to the ultrasonic wave and then, multiple fine bubbles are formed in the cleaning liquid L. The multiple fine bubbles in the cleaning liquid L collide with the outer circumferential surface of the supply roller 70 such that the liquid developer G in the cell 70A of the supply roller 70 is replaced with the cleaning liquid L.

Operation and Effect

Next, operations and effects of the exemplary embodiment will be described.

As shown in FIG. 3, when an image is formed, in the liquid developer supply device 40, the supply roller 70 rotates in the direction of the arrow B, the supply roller 70 comes into contact with the liquid developer reservoir 81 inside the chamber 72, and thereby the liquid developer G is supplied to the outer circumferential surface of the supply roller 70. Further, the outer circumferential surface of the supply roller 70 passes the contact portion with the regulation blade 80, thereby the surplus of the liquid developer G on the outer circumferential surface of the supply roller 70 is scraped, and the liquid developer G is held in the cell 70A of the supply roller 70. As shown in FIG. 2, the supply roller 70 is in contact with the developing roller 36, and the developing roller 36 rotates at a contact position with the supply roller 70 in the same direction as the supply roller. In this manner, the liquid developer G held in the cell 70A of the supply roller 70 is supplied to the developing roller 36. Then, the image is formed on the continuous paper P through a series of image forming processes of the image forming apparatus 10 (refer to FIG. 1).

In the liquid developer supply device 40, the cleaning process of cleaning the contact portion 79 between the supply roller 70 and the seal blade 78 is executed after the image is formed or after a predetermined period of time elapses after the image is formed. As shown in FIG. 4, in a state in which the rotation of the supply roller 70 is stopped, the on-off valve (not shown) of the cleaning vessel 84 is closed, and the cleaning liquid L is supplied to the inside of the cleaning vessel 84 through the supply tube (not shown). In this manner, the cleaning liquid reservoir portion 85 is formed inside the cleaning vessel 84, and the lower portion of the supply roller 70 is immersed into the cleaning liquid reservoir portion 85.

In this state, as shown in FIG. 5, when the supply roller 70 is caused to rotate in the direction of the arrow B, the cleaning liquid L is attached to the outer circumferential surface of the supply roller 70 with the rotation of the supply roller 70 and is brought along in the direction of arrow C. In this manner, the cleaning liquid L is supplied to the contact portion 79 from the upstream side of the contact portion 79 between the supply roller 70 and the seal blade 78. Therefore, the upstream side of the contact portion 79 between the supply roller 70 and the seal blade 78 in the rotating direction (direction of the arrow B) of the supply roller 70 is cleaned with the cleaning liquid L, and an attached substance such as the high-concentration liquid developer attached on the upstream side of the contact portion 79 between the supply roller 70 and the seal blade 78 is removed.

In addition, the seal blade 78 is disposed to be sloped downward from the front end portion 78B to the base end portion 78A side. Therefore, the cleaning liquid L supplied to the upstream side of the contact portion 79 between the supply roller 70 and the seal blade 78 flows down along the seal blade 78 in a direction represented by arrow D due to gravity. In other words, the cleaning liquid L flows down along the lower surface of the seal blade 78 due to gravity. The cleaning liquid L flowing down along the lower surface of the seal blade 78 due to gravity is collected in the cleaning vessel 84.

In addition, the ultrasonic oscillator 86 is provided in the cleaning vessel 84, the cleaning liquid L of the cleaning liquid reservoir portion 85 inside the cleaning vessel 84 vibrates with the ultrasonic wave, and multiple fine bubbles are formed in the cleaning liquid L. The multiple fine bubbles in the cleaning liquid L collide with the outer circumferential surface of the supply roller 70 such that the liquid developer G in the cell 70A of the supply roller 70 is replaced with the cleaning liquid L.

In the liquid developer supply device 40 of the exemplary embodiment, the high-concentration liquid developer accumulated in the contact portion 79 between the supply roller and the seal blade 78 is removed such that the high-concentration liquid developer enters into the chamber 72, as compared with a configuration which does not include the cleaning liquid supply device that supplies the cleaning liquid to the contact portion between the supply roller and the seal blade such that the cleaning liquid flows down along the seal blade due to gravity.

In addition, in the liquid developer supply device 40, the liquid developer G in the cell 70A of the supply roller 70 is more likely to be replaced with the cleaning liquid L such that the cleaning efficiency is improved, as compared with a configuration which does not include, below the supply roller, the cleaning liquid reservoir portion into which a part of the supply roller is immersed.

Further, in the liquid developer supply device 40, the liquid developer G in the cell 70A of the supply roller 70 is more efficiently replaced with the cleaning liquid (replacement of the liquid developer G by the cleaning liquid L is promoted) such that the cleaning efficiency is still more improved, as compared with a configuration which does not include the ultrasonic oscillator 86 in the cleaning vessel 84.

Second Exemplary Embodiment

Next, a liquid developer supply device as the second exemplary embodiment of the invention will be described with reference to FIG. 6. Note that the same reference signs are assigned to the same components as those in the first exemplary embodiment, and description thereof is omitted.

Figure 6:
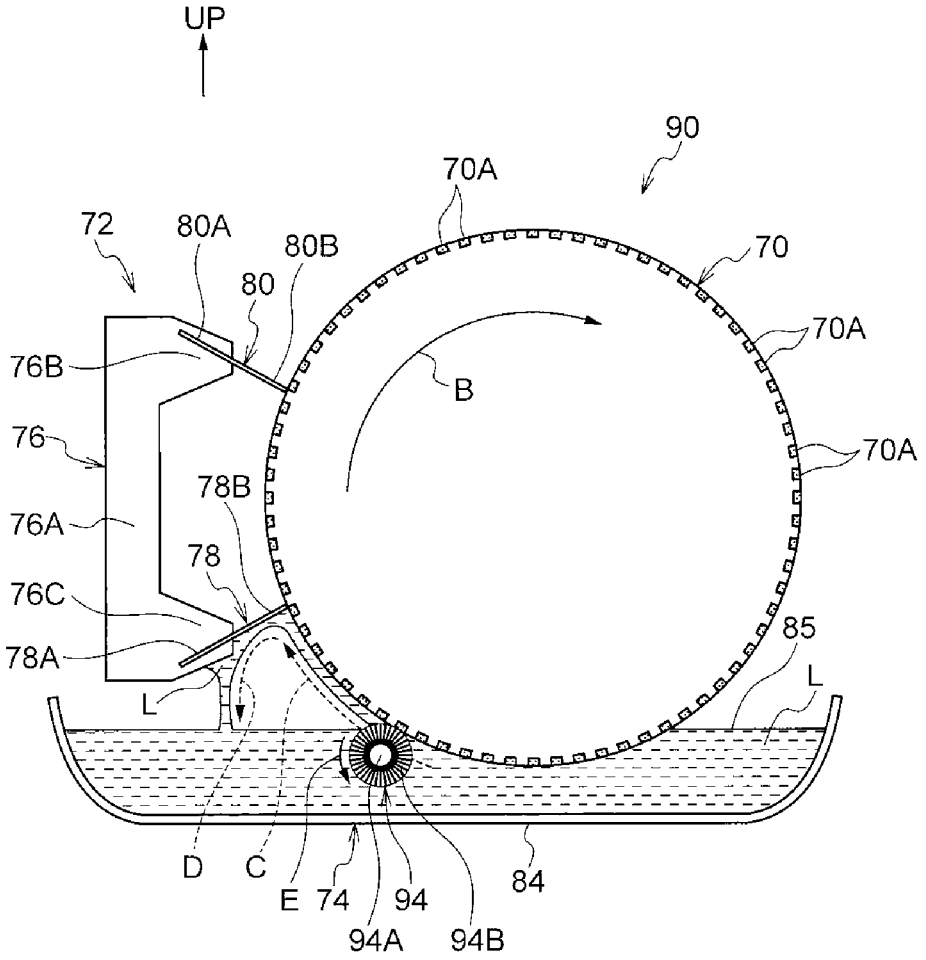
FIG. 6 is a view showing a configuration of the liquid developer supply device of a second exemplary embodiment in a state in which cleaning is performed.

As shown in FIG. 6, a liquid developer supply device 90 includes the cleaning liquid supply device 74 below the supply roller 70. In the cleaning liquid supply device 74, instead of the ultrasonic oscillator 86 of the first exemplary embodiment, a brush 94 as an example of the replacement portion is disposed in the inside of the cleaning vessel 84 so as to be in contact with the outer circumferential surface of the supply roller 70. The brush 94 has a shaft 94A that is rotatably supported in a support member (not shown) provided in the cleaning vessel 84, and multiple brush bristles 94B provided around the shaft 94A. The brush bristle 94B has, as an example, a length which is sufficient for a front end of the brush bristle 94B to come into contact with an inner wall of the cell 70A of the supply roller 70. In addition, the brush 94 is configured to rotate in a direction of arrow E along with the rotation of the supply roller 70.

The brush 94 is disposed to be immersed into the cleaning liquid reservoir portion 85 in the cleaning vessel 84 with the entirety or a part of the brush left without being immersed. In the exemplary embodiment, the brush 94 is disposed to be in contact with the outer circumferential surface of the supply roller 70 at a position at which the supply roller 70 emerges from the cleaning liquid reservoir portion 85 of the cleaning vessel 84 with the rotation of the supply roller 70.

In the liquid developer supply device 90, the brush 94, which is immersed in the cleaning liquid reservoir portion 85 in the cleaning vessel 84, rotates in contact with the outer circumferential surface of the supply roller 70. Therefore, the liquid developer G in the cell 70A of the supply roller 70 is more efficiently replaced with the cleaning liquid L (replacement of the liquid developer G by the cleaning liquid L is promoted) such that the cleaning efficiency is improved, as compared with a configuration which does not include the brush in the cleaning liquid reservoir portion 85 in the cleaning vessel 84.

Third Exemplary Embodiment

Next, a liquid developer supply device as the third exemplary embodiment of the invention will be described with reference to FIG. 7. Note that the same reference signs are assigned to the same components as those in the first and second exemplary embodiments, and description thereof is omitted.

Figure 7:
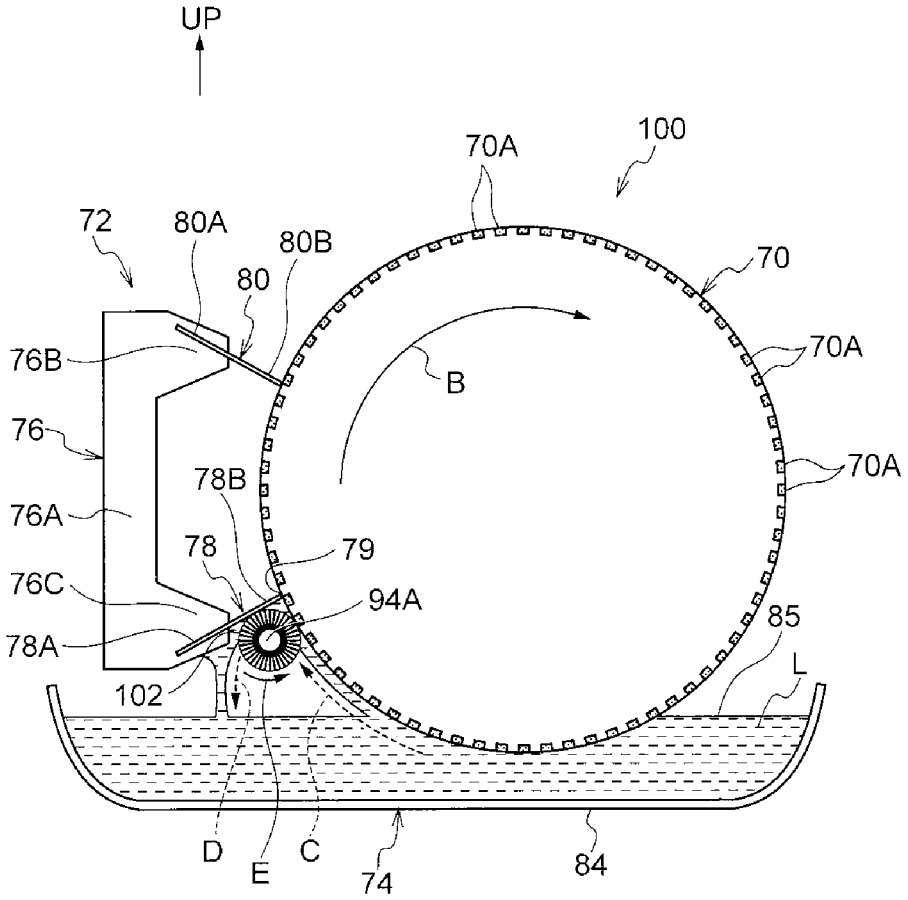
FIG. 7 is a view showing a configuration of the liquid developer supply device of a third exemplary embodiment in a state in which cleaning is performed.

As shown in FIG. 7, a liquid developer supply device 100 includes the cleaning liquid supply device 74 below the supply roller 70. In the cleaning liquid supply device 74, instead of the brush 94 of the second exemplary embodiment, a brush 102 as an example of the replacement portion is provided at a position at which the cleaning liquid L supplied to the supply roller 70 comes into contact with the supply roller. The brush 102 is provided at the position at which the seal blade 78 is in contact with the outer circumferential surface of the supply roller 70, on the upstream side of the contact portion 79 between the supply roller 70 and the seal blade 78 in the rotating direction (direction of the arrow B) of the supply roller 70. The brush 102 is rotatably supported to rotate in the direction of arrow E along with the rotation of the supply roller 70.

In the liquid developer supply device 100, the brush 102 is disposed on the upstream side of the contact portion 79 between the supply roller 70 and the seal blade 78 in the rotating direction of the supply roller 70, and the brush 102 rotates in contact with the outer circumferential surface of the supply roller 70 and the seal blade 78. Therefore, the liquid developer G in the cell 70A of the supply roller 70 is more efficiently replaced with the cleaning liquid L (replacement of the liquid developer G by the cleaning liquid L is promoted) such that the cleaning efficiency is improved, as compared with a configuration which does not include the brush at the position at which the cleaning liquid supplied to the supply roller comes into contact with the supply roller. In this manner, the attached substance such as the high-concentration liquid developer attached on the supply roller 70 or the seal blade 78, or the attached substance such as the high-concentration liquid developer attached in the vicinity of the contact portion 79 between the supply roller 70 and the seal blade 78 is removed.

Fourth Exemplary Embodiment

Next, a liquid developer supply device as the fourth exemplary embodiment of the invention will be described with reference to FIG. 8. Note that the same reference signs are assigned to the same components as those in the first to third exemplary embodiments, and description thereof is omitted.

Figure 8:
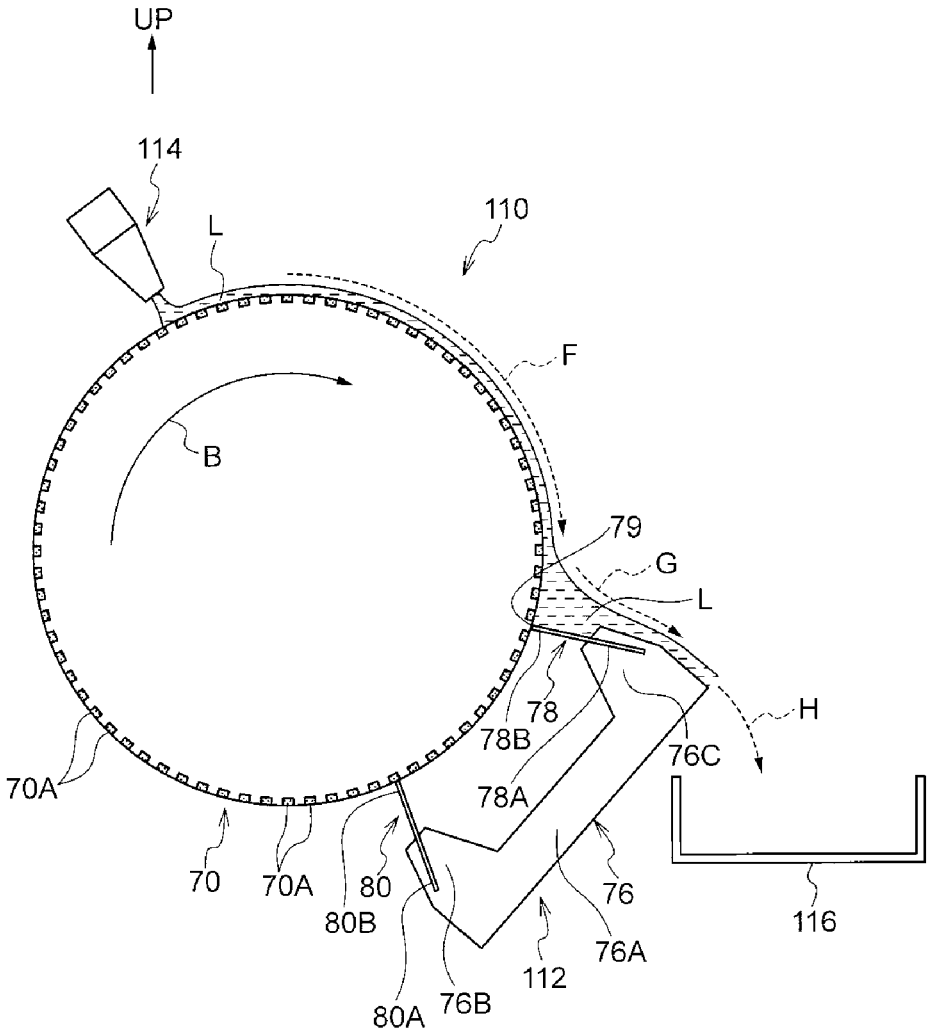
FIG. 8 is a view showing a configuration of the liquid developer supply device of a fourth exemplary embodiment in a state in which cleaning is performed.

As shown in FIG. 8, a liquid developer supply device 110 includes a chamber 112 as an example of a liquid developer supply unit, which is disposed at a position facing an obliquely lower side of the supply roller 70, and a nozzle 114 as an example of an ejection portion through which the cleaning liquid L is ejected to the supply roller 70 on the upstream side of the chamber 112 in the rotating direction of the supply roller 70.

The chamber 112 includes the storage member 76, the seal blade 78, and the regulation blade 80. In the exemplary embodiment, the side portion 76A of the storage member 76 is disposed to be inclined at a position facing an outer circumferential surface on the obliquely lower side of the supply roller 70. The downstream-side protruding portion 763, in which the regulation blade 80 is supported, is disposed on the lower end portion of the side portion 76A, and the upstream-side protruding portion 76C, in which the seal blade 78 is supported, is disposed on the upper end portion of the side portion 76A.

The seal blade 78 is disposed in a range in which the supply roller 70 moves downward. In other words, the front end portion 78B of the seal blade 78 is in contact with the supply roller 70 in the range in which the supply roller 70 moves downward. The seal blade 78 is disposed to be sloped downward from the front end portion 78B to the base end portion 78A. In the exemplary embodiment, the seal blade 78 is disposed below the central portion of the supply roller 70 in the vertical direction. In addition, in the exemplary embodiment, a liquid developer reservoir (not shown) is formed on the lower side of the chamber 112 on the regulation blade 80 side, and the seal blade 78 is disposed such that a surface thereof on the side opposite to the liquid developer reservoir (not shown) is directed downward. In addition, a collection member 116, in which the cleaning liquid L after flowing down along the seal blade 78 due to gravity is collected, is provided below the side (back surface side) of the storage member 76 opposite to the supply roller 70.

The nozzle 114 is disposed in the longitudinal direction of the supply roller 70 and the cleaning liquid L is continuously ejected through the nozzle to the rotating supply roller 70, thereby having a function of supplying the cleaning liquid L to the outer circumferential surface of the supply roller 70. A supply tube (not shown), through which the cleaning liquid L is supplied from the storage tank (not shown) using a pump, is connected to the nozzle 114.

The nozzle 114 is disposed on the upper side from the seal blade 78 in the vertical direction. The nozzle 114 is an example of a supply unit such that the cleaning liquid L is supplied to the contact portion 79 from the upstream side of the contact portion 79 between the supply roller 70 and the seal blade 78 in the rotating direction of the supply roller 70.

In the liquid developer supply device 110, the cleaning liquid L is ejected through the nozzle 114 to the rotating supply roller 70, and thereby the cleaning liquid L supplied to the outer circumferential surface of the supply roller 70 with the rotation of the supply roller 70 moves in a direction of arrow F. In this manner, the cleaning liquid L is supplied to the contact portion 79 between the supply roller 70 and the seal blade 78. Therefore, the contact portion 79 between the supply roller 70 and the seal blade 78 is cleaned with the cleaning liquid L, and the attached substance such as the high-concentration liquid developer accumulated on the upstream side of the contact portion 79 between the supply roller 70 and the seal blade 78 is removed. Further, the cleaning liquid L flows down along the seal blade 78 in a direction represented by arrow G due to gravity. In other words, the cleaning liquid L flows down along the top surface of the seal blade 78 due to gravity. The cleaning liquid L after flowing down along the top surface of the seal blade 78 due to gravity flows along the top surface of the storage member 76 and is collected in the collection member 116 on the back surface side of the storage member 76, in a direction represented by arrow H.

In the liquid developer supply device 110, high-concentration liquid developer accumulated in the contact portion 79 between the supply roller 70 and the seal blade 78 is removed such that the high-concentration liquid developer enters into the inside of the chamber 72, as compared with a configuration which does not include the supply unit that supplies the cleaning liquid to the contact portion between the supply roller and the seal blade such that the cleaning liquid flows down along the seal blade due to gravity. In addition, flexibility in selection of a position, at which the cleaning liquid L is supplied to the supply roller 70, is improved, as compared with a configuration which does not include the nozzle through which the cleaning liquid is ejected to the supply roller.

Further, the cleaning liquid L used in cleaning the contact portion 79 between the seal blade 78 and the supply roller 70 mixes with the cleaning liquid L ejected from the nozzle 114, as compared with a configuration in which the nozzle is disposed below the seal blade.

Fifth Exemplary Embodiment

Next, a liquid developer supply device as the fifth exemplary embodiment of the invention will be described with reference to FIG. 9. Note that the same reference signs are assigned to the same components as those in the first to fourth exemplary embodiments, and description thereof is omitted.

Figure 9:
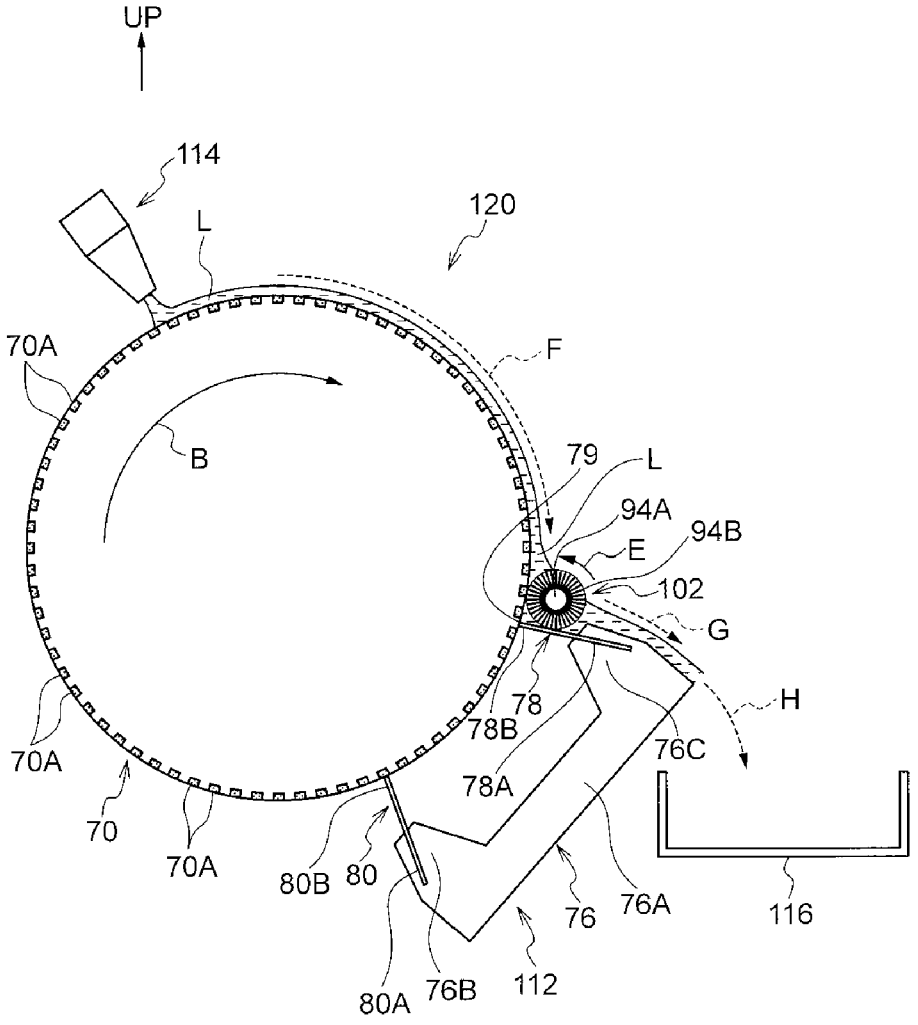
FIG. 9 is a view showing a configuration of the liquid developer supply device of a fifth exemplary embodiment in a state in which cleaning is performed.

As shown in FIG. 9, a liquid developer supply device 120 includes the brush 102 as an example of the replacement portion, which is provided at a position at which the cleaning liquid L supplied to the supply roller 70 comes into contact with the supply roller. The brush 102 is provided at the position at which the seal blade 78 is in contact with the outer circumferential surface of the supply roller 70, on the upstream side of the contact portion 79 between the supply roller 70 and the seal blade 78 in the rotating direction (direction of the arrow B) of the supply roller 70. The brush 102 rotates in the direction of the arrow E along with the rotation of the supply roller 70.

In the liquid developer supply device 120, the liquid developer G in the cell 70A of the supply roller 70 is more efficiently replaced with the cleaning liquid L (replacement of the liquid developer G by the cleaning liquid L is promoted) such that the cleaning efficiency is improved, as compared with a configuration which does not include the brush at the position at which the cleaning liquid supplied to the supply roller comes into contact with the supply roller. In this manner, the attached substance such as the high-concentration liquid developer attached on the supply roller 70 or the seal blade 78, or the attached substance such as the high-concentration liquid developer attached in the vicinity of the contact portion 79 between the supply roller 70 and the seal blade 78 is removed.

Note that the position of the brush 102 is not limited to that in the exemplary embodiment, but may be changed as long as the cleaning liquid L supplied to the supply roller 70 comes into contact with the supply roller at the position.

Sixth Exemplary Embodiment

Next, a liquid developer supply device as the sixth exemplary embodiment of the invention will be described with reference to FIG. 10. Note that the same reference signs are assigned to the same components as those in the first to fifth exemplary embodiments, and description thereof is omitted.

Figure 10:
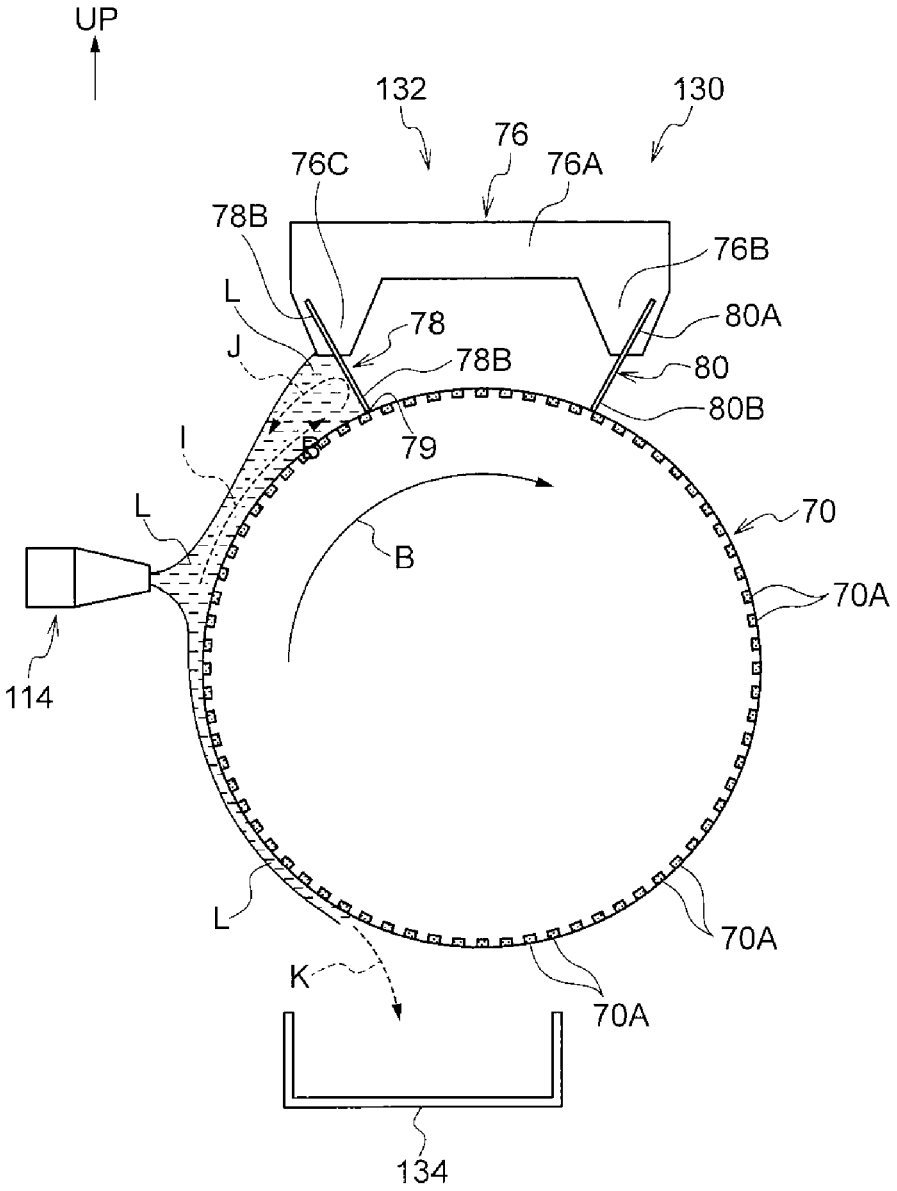
FIG. 10 is a view showing a configuration of the liquid developer supply device of a sixth exemplary embodiment in a state in which cleaning is performed.

As shown in FIG. 10, a liquid developer supply device 130 includes a chamber 132 as an example of the liquid developer supply unit, which is disposed at a position facing an upper portion of the supply roller 70, and the nozzle 114 as an example of the ejection portion through which the cleaning liquid L is ejected to the supply roller 70 on the upstream side of the chamber 132 in the rotating direction of the supply roller 70.

The chamber 132 includes the storage member 76, the seal blade 78, and the regulation blade 80. In the exemplary embodiment, the side portion 76A of the storage member 76 is disposed in a lateral direction so as to intersect with the axial direction of the supply roller 70 at a position facing an outer circumferential surface on the upper side of the supply roller 70. The seal blade 78 is disposed to be sloped down from the base end portion 78A to the front end portion 78B side. In the exemplary embodiment, the seal blade 78 is disposed such that a surface thereof on the side opposite to the liquid developer reservoir (not shown) which is formed in the chamber 132 is directed downward.

The nozzle 114 is disposed on the lower side from the seal blade 78 in the vertical direction such that the cleaning liquid L is supplied to the contact portion 79 from the upstream side of the contact portion 79 between the supply roller 70 and the seal blade 78 in the rotating direction of the supply roller 70. In addition, a collection member 134, in which the cleaning liquid L after flowing over the seal blade 78 due to gravity and farther flowing down along the outer circumferential surface of the supply roller 70 is collected, is provided below the supply roller 70.

In the liquid developer supply device 130, the cleaning liquid L is ejected through the nozzle 114 to the rotating supply roller 70, and thereby the cleaning liquid L supplied to the outer circumferential surface of the supply roller 70 with the rotation of the supply roller 70 moves in a direction of arrow I. In this manner, the cleaning liquid L is supplied to the contact portion 79 between the supply roller 70 and the seal blade 78. Therefore, the contact portion 79 between the supply roller 70 and the seal blade 78 is cleaned with the cleaning liquid L, and the attached substance such as the high-concentration liquid developer accumulated on the upstream side of the contact portion 79 between the supply roller 70 and the seal blade 78 is removed. Further, the cleaning liquid L supplied to the contact portion 79 between the supply roller 70 and the seal blade 78 is once diverted to the upper side of the seal blade 78 due to the fluid pressure of the cleaning liquid L in the direction of the arrow I and flows down to the outer circumferential surface side of the supply roller 70 along the seal blade 78 in a direction represented by arrow J due to gravity. Furthermore, the cleaning liquid L flows down along the outer circumferential surface of the supply roller 70 due to gravity and then, is collected in the collection member 134 disposed below the supply roller 70 in a direction represented by arrow K.

In the liquid developer supply device 130, high-concentration liquid developer accumulated in the contact portion 79 between the supply roller 70 and the seal blade 78 is removed such that the high-concentration liquid developer enters into the inside of the chamber 72, as compared with a configuration which does not include the supply unit that supplies the cleaning liquid to the contact portion between the supply roller and the seal blade such that the cleaning liquid flows down along the seal blade due to gravity. In addition, flexibility in selection of a position, at which the cleaning liquid L is supplied to the supply roller 70, is improved, as compared with a configuration which does not include the nozzle through which the cleaning liquid is ejected to the supply roller.

Note that, in the first to sixth exemplary embodiments, the plural cells 70A are provided in the outer circumferential surface of the supply roller 70; however, the invention is not limited to the configurations described above. For example, a configuration, in which plural grooves as an example of the recessed portion are provided on the outer circumferential surface of the supply roller 70, may be employed.

In addition, in the fourth to sixth exemplary embodiments, the nozzle 114, through which the cleaning liquid L is ejected to the supply roller 70, is used; however, the invention is not limited to the configurations. For example, a cleaning liquid supply member such as a roller, which supplies the cleaning liquid L to the supply roller 70, may be provided.

In addition, the second, third, or fifth exemplary embodiment has a configuration in which the brush that is in contact with the supply roller 70 rotates along with the rotation of the supply roller 70; however, the invention is not limited to this configuration. For example, the brush may be configured to be rotated and driven separately from the supply roller 70, and the brush may be rotated in an opposite direction thereto at the position at which the brush is in contact with the supply roller 70.

In addition, in the second and third exemplary embodiments, the brush is provided as an example of the replacement portion; however, the invention is not limited thereto. For example, a configuration, in which the brush and the ultrasonic oscillator provided in the cleaning vessel are together used, may be employed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer supply device comprising:

a supply roller that rotates and holds liquid developer in a recessed portion formed in an outer circumferential surface to supply the liquid developer to a receiving member;

a liquid developer supply unit that supplies liquid developer between a seal member which is in contact with the supply roller on an upstream side in a rotating direction and a regulation member which is in contact with the supply roller on a downstream side, and that forms a liquid developer reservoir; and a supply unit that supplies a cleaning liquid to a contact portion from an upstream side of the contact portion between the supply roller and the seal member, in the rotating direction of the supply roller, such that the cleaning liquid flows down along the seal member due to gravity so as to reach a point distant from the supply roller.

2. The liquid developer supply device according to claim 1, wherein the supply unit includes an ejection portion that ejects the cleaning liquid to the supply roller at a position facing the supply roller.

3. The liquid developer supply device according to claim 2, wherein the ejection portion is disposed on an upper side of the seal member in a vertical direction, and wherein the seal member is disposed in a range in which the supply roller moves downward.

4. The liquid developer supply device according to claim 3, further comprising:

a replacement portion that is provided at a position at which the replacement portion is in contact with the cleaning liquid supplied to the supply roller, and that causes liquid developer in the recessed portion of the supply roller to be replaced with the cleaning liquid.

5. A developing device comprising:

the liquid developer supply device according to claim 3, wherein the receiving member is a developing roller that rotates in contact with the supply roller and that holds liquid developer.

6. The liquid developer supply device according to claim 2, further comprising:

a replacement portion that is provided at a position at which the replacement portion is in contact with the cleaning liquid supplied to the supply roller, and that causes liquid developer in the recessed portion of the supply roller to be replaced with the cleaning liquid.

7. A developing device comprising:

the liquid developer supply device according to claim 2, wherein the receiving member is a developing roller that rotates in contact with the supply roller and that holds liquid developer.

8. The liquid developer supply device according to claim 1, further comprising:

a replacement portion that is provided at a position at which the replacement portion is in contact with the cleaning liquid supplied to the supply roller, and that causes liquid developer in the recessed portion of the supply roller to be replaced with the cleaning liquid.

9. A developing device comprising:

the liquid developer supply device according to claim 8, wherein the receiving member is a developing roller that rotates in contact with the supply roller and that holds liquid developer.

10. A developing device comprising:

the liquid developer supply device according to claim 1, wherein the receiving member is a developing roller that rotates in contact with the supply roller and that holds liquid developer.

11. An image forming apparatus comprising:

the developing device according to claim 10; and an image holding member that has a surface on which a latent image is formed so that the developing device develops the latent image.

12. A liquid developer supply device comprising:

a supply roller that rotates and holds liquid developer in a recessed portion formed in an outer circumferential surface to supply the liquid developer to a receiving member;

a liquid developer supply unit that supplies liquid developer between a seal member which is in contact with the supply roller on an upstream side in a rotating direction and a regulation member which is in contact with the supply roller on a downstream side, and that forms a liquid developer reservoir; and a supply unit that supplies a cleaning liquid to a contact portion from an upstream side of the contact portion between the supply roller and the seal member, in the rotating direction of the supply roller, such that the cleaning liquid flows down along the seal member due to gravity, wherein the supply unit immerses a part of the supply roller into a cleaning liquid reservoir portion disposed below the supply roller to supply the cleaning liquid to the contact portion with the rotation of the supply roller, and wherein the seal member is disposed in a range in which the supply roller moves upward from the cleaning liquid reservoir portion.

13. The liquid developer supply device according to claim 12, wherein the cleaning liquid reservoir portion is provided with a replacement portion that causes liquid developer in the recessed portion of the supply roller to be replaced with the cleaning liquid.

14. The liquid developer supply device according to claim 13, further comprising:

a replacement portion that is provided at a position at which the replacement portion is in contact with the cleaning liquid supplied to the supply roller, and that causes liquid developer in the recessed portion of the supply roller to be replaced with the cleaning liquid.

15. A developing device comprising:

the liquid developer supply device according to claim 13, wherein the receiving member is a developing roller that rotates in contact with the supply roller and that holds liquid developer.

16. The liquid developer supply device according to claim 12, further comprising:

a replacement portion that is provided at a position at which the replacement portion is in contact with the cleaning liquid supplied to the supply roller, and that causes liquid developer in the recessed portion of the supply roller to be replaced with the cleaning liquid.

17. A developing device comprising:

the liquid developer supply device according to claim 12, wherein the receiving member is a developing roller that rotates in contact with the supply roller and that holds liquid developer.

18. An image forming apparatus comprising:

the developing device according to claim 17; and an image holding member that has a surface on which a latent image is formed so that the developing device develops the latent image.

19. A liquid developer supply device comprising:

a supply roller that rotates and holds liquid developer in a recessed portion formed in an outer circumferential surface to supply the liquid developer to a receiving member;

a liquid developer supply unit that supplies liquid developer between a seal member which is in contact with the supply roller on an upstream side in a rotating direction and a regulation member which is in contact with the supply roller on a downstream side, and that forms a liquid developer reservoir;

a supply unit that supplies a cleaning liquid to a contact portion from an upstream side of the contact portion between the supply roller and the seal member, in the rotating direction of the supply roller, such that the cleaning liquid flows down along the seal member due to gravity; and a replacement portion that is provided at a position at which the replacement portion is in contact with the cleaning liquid supplied to the supply roller, and that causes liquid developer in the recessed portion of the supply roller to be replaced with the cleaning liquid, wherein the replacement portion includes a brush that is provided to rotate at a position at which the brush is in contact with the seal member and the supply roller, on the upstream side of the seal member in the rotating direction of the supply roller.

20. A developing device comprising:

the liquid developer supply device according to claim 19, wherein the receiving member is a developing roller that rotates in contact with the supply roller and that holds liquid developer.

* * * * *